US006321902B1

(12) United States Patent
Stäb

(10) Patent No.: US 6,321,902 B1
(45) Date of Patent: Nov. 27, 2001

(54) METHOD FOR DIVIDING THE FLOW OF SIGNATURES

(75) Inventor: Rudolf Stäb, Frankenthal (DE)

(73) Assignee: Koenig & Bauer Aktiengesellschaft, Wurzburg (DE)

( * ) Notice: Subject to any disclaimer, the term of this patent is extended or adjusted under 35 U.S.C. 154(b) by 0 days.

(21) Appl. No.: 09/463,963

(22) PCT Filed: Aug. 13, 1998

(86) PCT No.: PCT/DE98/02338

§ 371 Date: Feb. 10, 2000

§ 102(e) Date: Feb. 10, 2000

(87) PCT Pub. No.: WO99/08952

PCT Pub. Date: Feb. 25, 1999

(30) Foreign Application Priority Data

Aug. 13, 1997 (DE) ..... 197 35 051

(51) Int. Cl.[7] ..... B65H 5/32
(52) U.S. Cl. ..... 198/644; 271/303
(58) Field of Search ..... 198/644; 271/303

(56) References Cited

U.S. PATENT DOCUMENTS 4,373,713 2/1983 Loebach ..... 271/303
4,650,174 * 3/1987 Stobb ..... 270/53
6,145,649 * 11/2000 Belanger et al. ..... 198/493
6,186,489 * 4/1999 Bredenberg et al. ..... 271/3.24
6,213,461 * 4/2001 Ratz et al. ..... 271/187

FOREIGN PATENT DOCUMENTS 3210 5/1878 (DE) .
1223682 3/1967 (DE) .
3424389 A1 3/1985 (DE) .
0254037 A2 1/1988 (EP) .

* cited by examiner

*Primary Examiner*—Christopher P. Ellis
*Assistant Examiner*—Rashmi Sharma
(74) *Attorney, Agent, or Firm*—Jones, Tullar & Cooper, PC

(57) ABSTRACT

A device for dividing the flow of signatures into two paths of signatures uses two cam rows and a stationary guide wedge. Two conveyor belt systems initially deliver the signatures to a leading edge of the guide wedge. This leading edge is provided with guide channels into and out of which the conveyor belts in each of the two conveyor belt systems are alternatingly moved by high and low cam portions of the cam disks carried on the two cam rows.

18 Claims, 4 Drawing Sheets

METHOD FOR DIVIDING THE FLOW OF SIGNATURES

FIELD OF THE INVENTION

The invention-relates to a device for rerouting signatures clamped between first and second conveyor belts. A guide wedge system extends transversely to the conveying direction of the conveyor belts. The conveyor belts ride on different conveying tracks.

A device for dividing a flow of signatures into two partial flows is known from EP 0 254 037 A1. This is accomplished in that conveyor belts, between which the signatures are clamped, respectively rest against the circumference of two oppositely disposed control rollers, which are eccentrically and rotatably seated. The two control rollers oscillate in a timed manner and alternatingly push the signatures via the conveyor belts against a deflection edge of a guide wedge. From there, they reach a first, or respectively a second conveying track.

Furthermore, a device for sorting sheets of paper or the like, which are guided between conveyor belts, is known from DE-PS 1 223 682, wherein one of two conveying tracks is selectively blocked. This is accomplished in that a deflection member pushes the conveyor belts against a guide face of a guide wedge. At that time, the second conveying track is open.

DE 3210 C discloses a sheet distributor by means of belt systems and a wedge arranged between them. This wedge is pivotably arranged as a shunt between belts of the belt system.

The object of the present invention is based on providing a device for rerouting signatures in a flow of signatures into two partial flows on two conveying tracks.

In accordance with the present invention, this object is attained by providing first and second conveyor belts which clamp the signatures and move them in a conveying direction from an infeed conveying track to a first conveying track and a second conveying track. A guide wedge extends transversely to the conveying direction and has upper and lower guide surfaces. The belts move on different conveying tracks which are typically formed on the guide surfaces of the guide wedge.

The advantages to be achieved by the present invention consist, in particular, in that the front edges of the signatures do not push against the deflection edge of the guide wedge, where they could cause a pile-up in this way. The service life of the conveyor belts is increased, because they need not drive any control rollers.

If thick signatures—for example with 64 pages—are to be rerouted, it is advantageous if the base circle of at least one of the two cam disks, or respectively cam rollers, having the radius r1, or respectively r4, on which the high cams have been placed, has a multiply larger diameter with several taller cams than the other cam roller arranged opposite it and working together with it. Only slightly harmful displacement forces between the inner and outer layers of the signatures are then created in the course of deflecting, i.e. during the directional change of the signatures.

BRIEF DESCRIPTION OF THE DRAWINGS

A preferred embodiment of the present invention is represented in the drawings and will be explained in greater detail in what follows.

Shown are in.

DESCRIPTION OF THE PREFERRED EMBODIMENT

Figure 1:
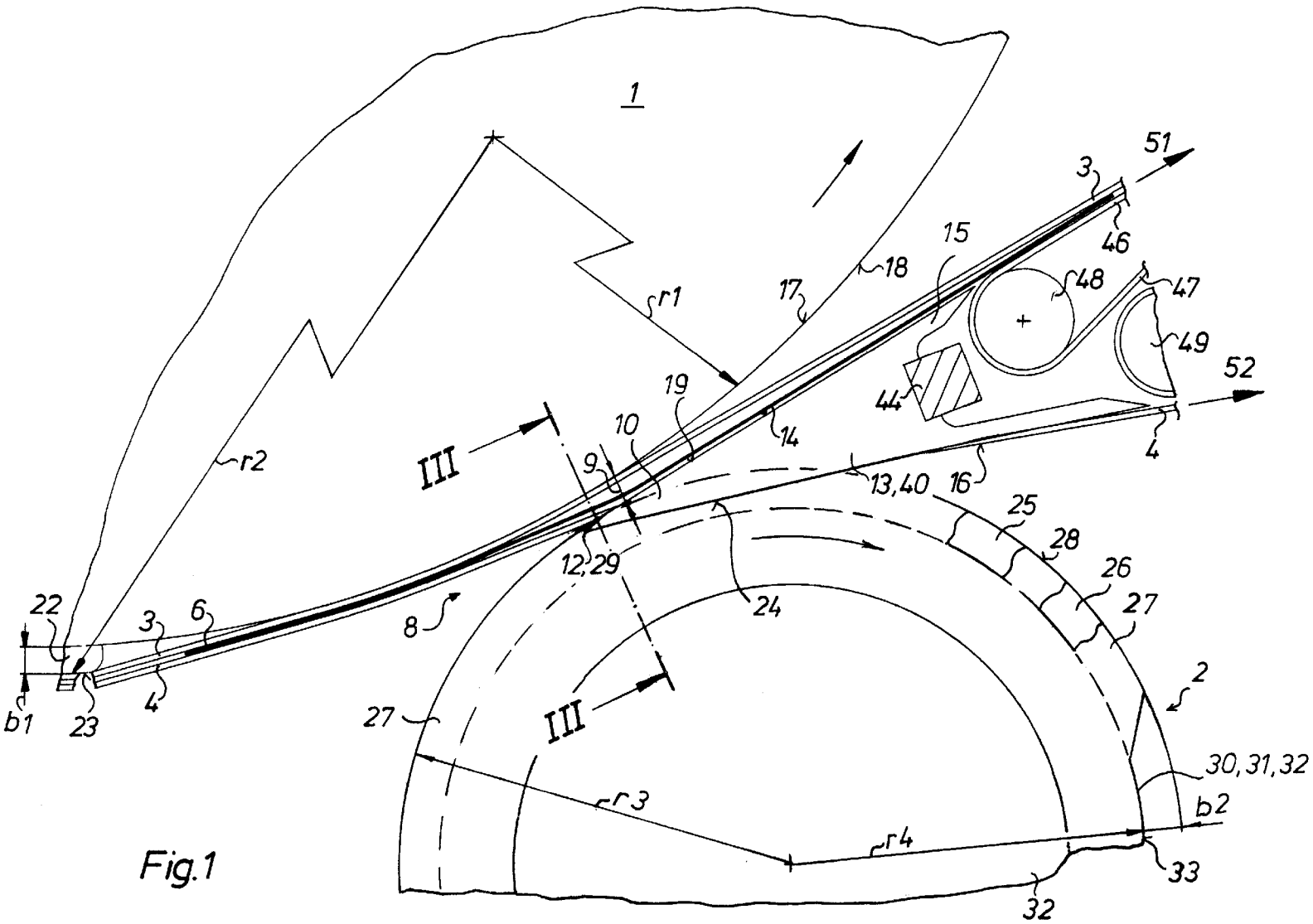
FIG. 1, a schematic side elevation view of a device for rerouting signatures in a flow of signatures in accordance with the present invention in a first work position and releasing a first conveying track for the signatures, FIG. 2, a schematic side elevation view of the device of FIG. 1, but in a second work position and releasing a second conveying track for the signatures, FIG. 3, an enlarged view taken along line III—III in FIG. 1, and in FIG. 4, an enlarged view taken along line IV—IV in FIG. 2.
Figure 2:
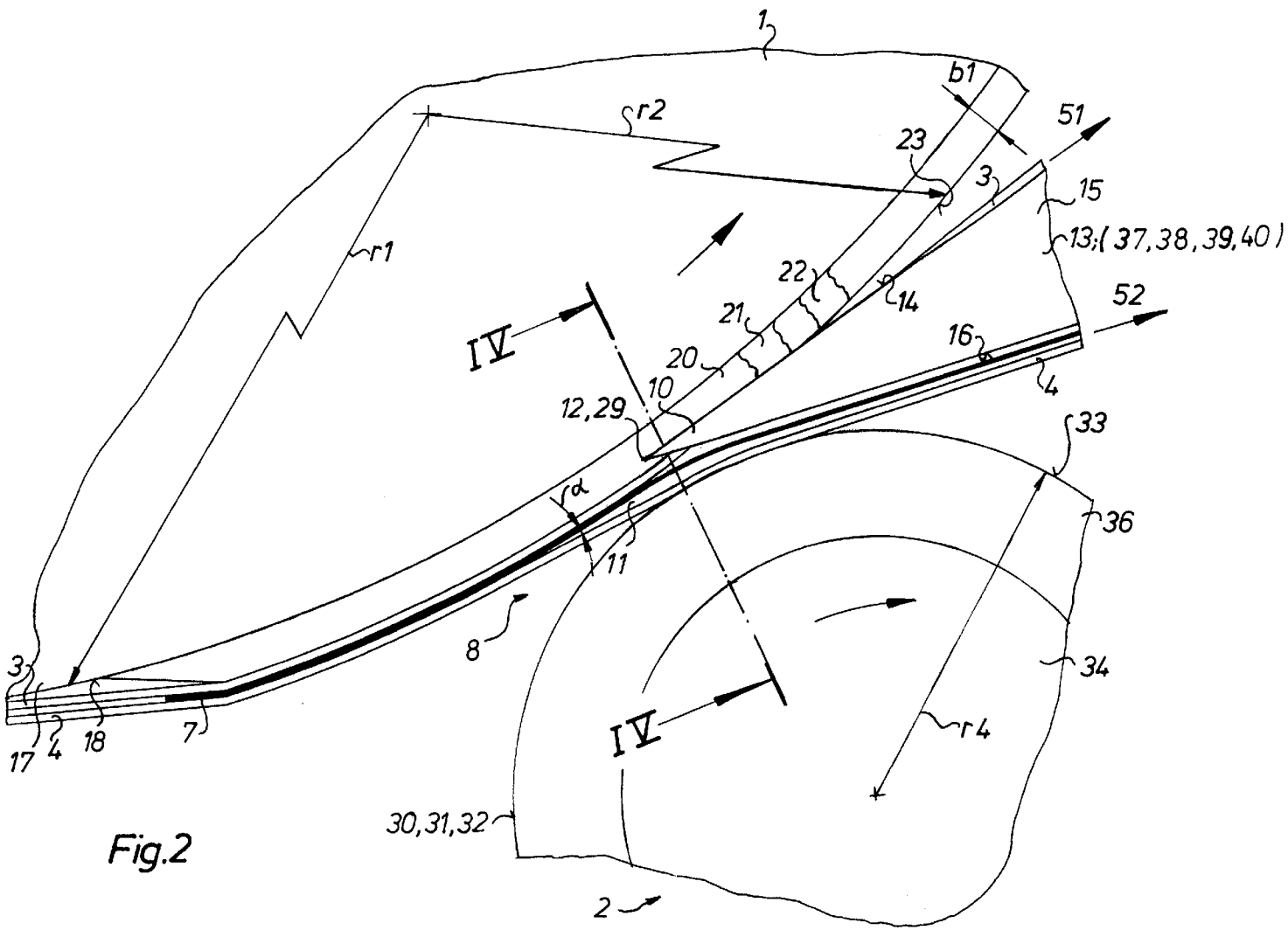

The device for dividing the flow of signatures, in accordance with the present invention consists essentially of a first cam roller or cam row 1, with one or a plurality of transversely spaced cams, each defining high cams 20, 21, 22 and low cams 17, and a second cam roller or cam row 2, with one or a plurality of transversely spaced cams, each defining high cams 25, 26, 27 and low cams 30, 31, 32, all as seen in FIGS. 1 and 2 which are arranged meshing or interdigitating and revolving with each other and which are axis-parallel with each other. It will be understood that each cam on each cam row has a high cam segment and a low cam segment and that these segments are circumferentially spaced on each cam.

Conveyor belts of two driven conveyor belt systems 3, 4 run between the oppositely located cams of the cam rows 1, 2 and rest against the circumferences of the cams in these two cam rows 1 and 2. Each of the conveyor belt systems 3, 4 consists of several conveyor belts. Signatures 6, 7 are clamped between the conveyor belts of the conveyor belt systems 3, 4 in the following alternating sequence: signature 6—signature 7—signature 6—signature 7—and they reach an entry wedge area 8 between the oppositely located cams of the two cam rows 1, 2.

The signatures 6, 7 had previously been created in a known manner by transverse cutting of a paper strand. They can be folded or not folded.

The conveyor belts of the conveyor system 3, 4 which may be referred to as conveyor belts 3, 4 together enter a gap 9 in the entry wedge between the cams of the cam rows 1, 2, in a signature infeed conveying track and thereafter separate at an acute opening angle ' of, for example, 10° and continue to run in separate first and second or upper and lower conveying tracks 51, 52, respectively. In the process, the conveyor belts 3, 4 form an outlet wedge 11 downstream of the gap 9.

Downstream of the outlet wedge 11, the conveyor belts 3, 4 are conducted over guide rollers, not represented, to processing stations, longitudinal folding devices, etc.

Figure 3:
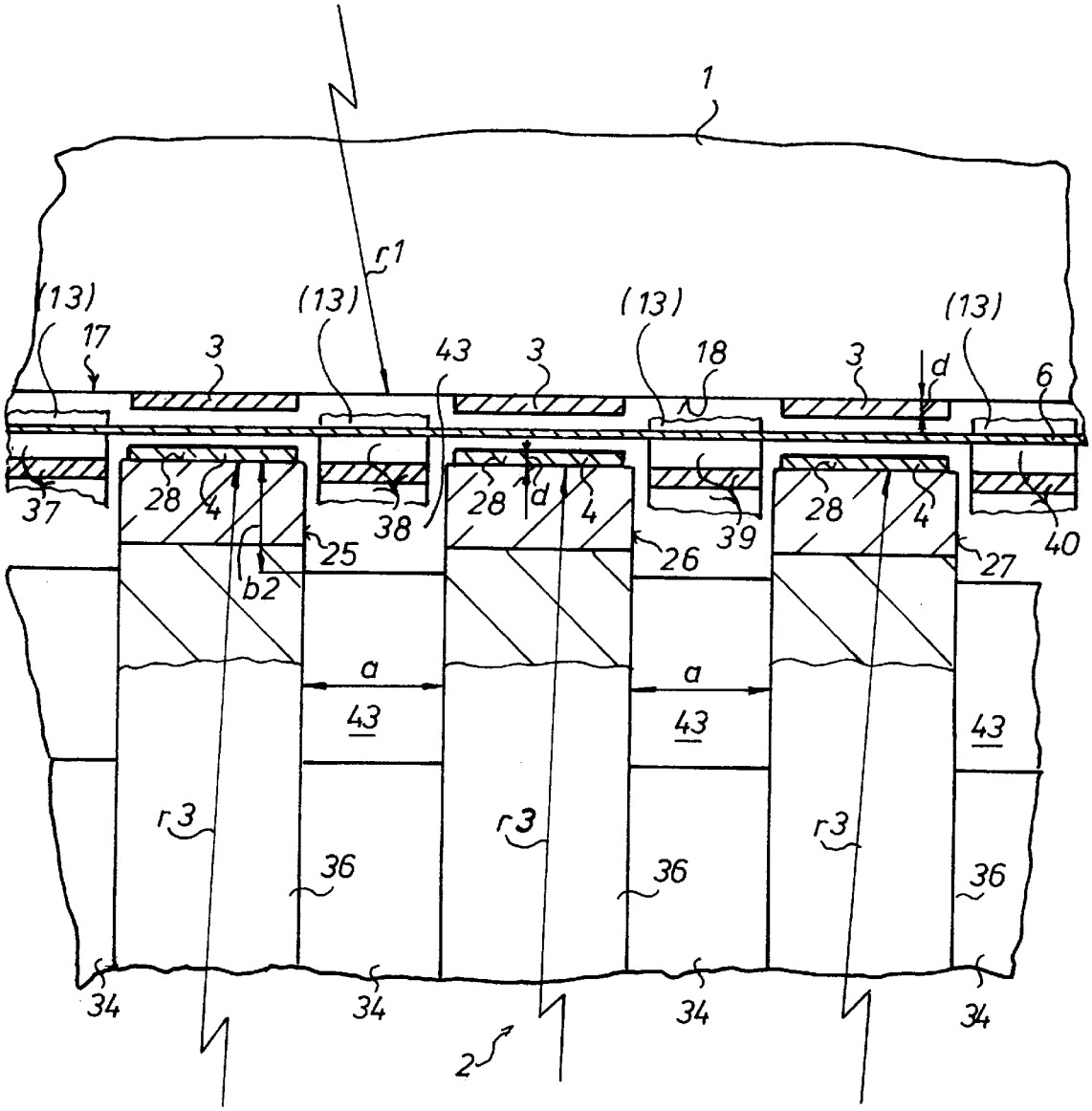
Figure 4:
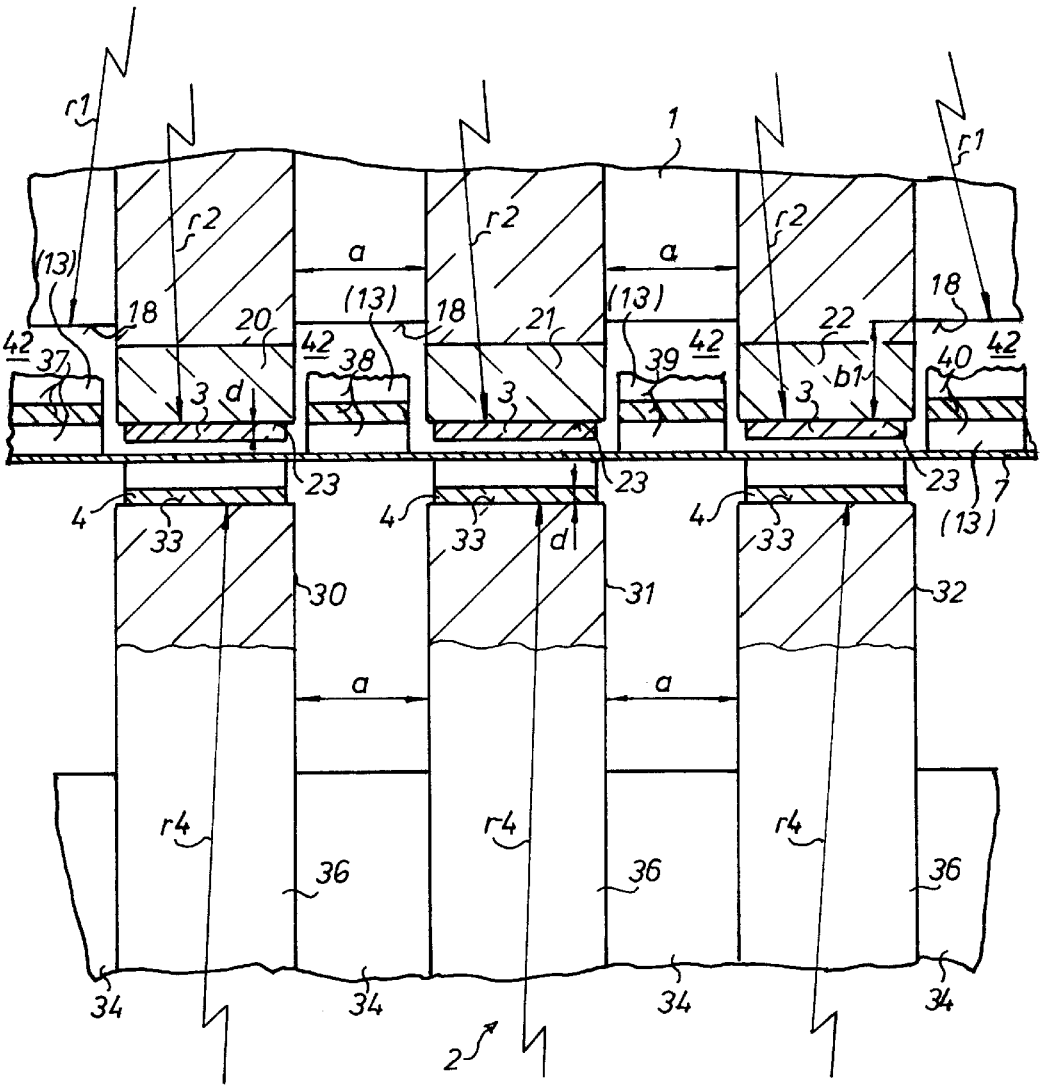

The first, upper cam row 1 has alternatingly one or several low cams 17 with a respectively small radius r1 and a low control surface 18, as seen in FIG. 3 on its circumference, as well as one or several higher cams 20, or respectively 21, or respectively 22, with a large radius r2 and a high control surface 23, as may be seen in FIG. 4.

A stroke distance b1 between the low and the high control surfaces 18, 23 of the low cams 17 and the high cams 20, 21, 22 respectively of the first, upper cam roll 1 can extend between two and six millimeters. A stroke distance b2 between the low control surfaces 33 of the low cams 30, 31, 32, and the high control surfaces 28 of the high cams 25, 26, or 27 of the second cam row 2 correspondingly can also be between two and six millimeters.

The cam row 1 can be designed in different ways, for example, it can consist of a tube-shaped roller with high cams 20, 21, 22, which are spaced apart from each other and which extend in a strip-shape in the circumferential direction, or it can have several cam disks, which are spaced apart at a distance a1 from each other and are which kept apart by spacers 34, for example.

The second cam row 2 can be designed in accordance with the same structural principles as the first cam row 1, but has a reduced diameter. The second cam row 2 which may be, for example ring-shaped, has high cams 25, or respectively 26, or respectively 27, which are spaced apart at a clear distance a2, extend in the circumferential direction, and have a respective radius r3 and a high control surface 28, and low cams 30, 31, 32, which respectively adjoin the high cams 25 to 27 in the circumferential direction of the roller 2 and have a low radius r4 and respectively low control surfaces 33.

Besides the embodiments already explained, such as for example strip-shaped control surfaces placed on a roller, or cam rollers 36 kept apart by spacers 34, as shown in FIGS. 3 and 4, the cam rows 1, 2 can also consist of a roller with circumferential annular grooves which is circular in cross section, but which is eccentrically seated.

A guide wedge 13, which fixed in place on a frame and having an upper guide surface 14 and a lower guide surface 16, is provided.

The guide wedge extends opposite the conveying direction of the conveyor belts 3, 4 with its cutter-shaped deflection edge 12, or respectively its thin end 10. The cutter-shaped deflection edge on the thin end 10 can be designed with a sharp edge, but can also be rounded.

The guide wedge 13 can consist for example—viewed in the axial direction of the cam roller 1, 2—of several spaced apart individual guide wedges 37, 38, 39, 40, but can also be designed comb-like with "teeth" and free spaces between them. The thin ends 10 of the guide wedge 13, or respectively the individual guide wedges 37 to 40 are respectively located between the axially adjoining cams 20, 21, 22.

In the course of the rotating movement of the cam rows 1, 2, the low cams 17 with the low control surface 18 of the first cam row 1 respectively act together with the high cams 25, 26, 27 with the high control surface 28 of the second cam row 2, as well as with the respective conveyor belts 3, 4 resting against them, i.e. they mesh with each other. The high cams 20, 21, 22 with the high control surface 23 of the first cam row 1 work together with the low cams 30, 31, 32 with the low control surface 33 of the second cam row 2, and vice versa. Respective conveyor belts 3, 4 rest on their control surface.

The signatures 6, or respectively 7, traverse a free space above the upper guide surface(s) 14 of the guide wedge 13 as seen in FIGS. 1 and 3, or respectively a free space below the lower guide surface(s) 16 (FIGS. 2 and 4) of the individual guide wedges 37, 38, 39, 40, as shown in FIGS. 2 and 4.

The individual guide wedges 37 to 40 are fastened, spaced apart in respect to each in the axial direction of the cam rollers 1,2, on a cross bar 44, which is fixed in place on the lateral frame, and which is shown in FIG. 1.

In accordance with another preferred embodiment, the individual wedges 37 to 40 are fastened in an interlocking manner, or connected because they are of the same material, comb-like with their thick ends 15 on the cross bar, or respectively cross beam 44, which is fixed in place on the lateral frame. The conveyor belts 3, 4 are then pushed, in a timed manner by the high cams 20 to 22, or respectively 25 to 27, into the free gaps 42, or respectively 43, between or next to the individual guide wedges 37 to 40. In the course of this, the conveyor belts 3, 4 dip with their entire thickness d, or with only a portion thereof, into these gaps 42 or 43.

In the course of this movement of the conveyor belts 3 and 4 with respect to the guide wedge or wedges, the respective high control surface 23 of the high cams 20 to 22 pushes the upper conveyor belt 3 resting against it over its entire or partial thickness d into a free space between two "guide teeth" of the guide wedge 13, which is designed in the shape of a comb, or respectively between two individual guide wedges 37 to 40, or one to the left or the right of these.

In the process, the upper conveyor belt 3 moves, with its entire or partial thickness, through the free space enclosed in the virtual extension, as viewed in the axial direction of the cam row 1, or respectively 2, by the upper guide surface 14 and the lower guide surface 16. This occurs in a meshing way from the direction of the lower guide surface 16 up past the upper guide surface 14.

The virtual extension of the lower guide surface 16, as viewed in the axial direction of the cam row 1, or respectively 2—partially or completely intersects the movement track of the conveyor belt 3 seated on the high cams 20, 21, 22. The insertion of the signatures 7 into the lower conveying track 52 is achieved by this, as is depicted in FIG. 2.

The respective guide surfaces 14, 16 of the individual guide wedges 37 to 40 are designed to be flat. In accordance with another preferred embodiment, the guide surfaces, and in particular the portions of the guide surfaces 14, 16 of the individual guide wedges 37 to 40 located in the vicinity of the deflection edge 12, are respectively concavely curved.

At the respective end, close to the cross bar, of the upper and lower guide surface 14, 16 of the guide wedge 13, or respectively of the individual guide wedges 37 to 40, further conveyor belts 46, 47 are arranged in addition to the conveyor belts 3, 4 and cooperate with them. These conveyor belts 46, 47 are respectively guided around reversing rollers 48, 49. They constitute the continuation of the conveying tracks 51, or respectively 52.

It can be advantageous if the first cam row—here the first cam row 1—, on which the flow of signatures 6 and 7 is first moved, has a whole number multiple of cams in comparison with the second cam row 2 working together with it, for example 6 cams to 2 cams. By means of this step, it is possible to reroute thicker signatures 6 without harmful displacement forces between the inner and outer layers of the signature 6 occurring.

The virtual extension of the upper guide surface 14—viewed in the axial direction of the cam row 1, or respectively 2—towards the left and right is defined as virtual guide surface 19, as seen in FIG. 1.

The virtual extension of the lower guide surface 16—viewed in the axial direction of the cam roller 1, or respectively 2—towards the left and right is defined as virtual guide surface 24. This lower vertical guide surface 24 is also shown in FIG. 1.

The device for dividing the flow of signatures in accordance with the present invention operates as follows: the signatures 6, 7, which are clamped between the conveyor belts 3, 4, are fed to the entry wedge 8. These signatures 6, 7 are alternatingly distributed onto the first and second conveying tracks 51, 52. In the course of this, because of the position of the first cam row 1 with the low control surface 18 of the low cam 17, respectively one signature, for example a signature 6, is guided, sliding on the free upper guide surface 14 of the guide wedge 13, from the upper conveyor belt system 3 to the conveying track 51. Simultaneously, the high control surface 28 of the high cam 25 of the lower cam row 2 has respectively lifted the lower conveyor belts 4 of the lower conveyor belt system 4 sufficiently so that they move, with their entire or partial thickness through the free space between two guide teeth of a comb-like embodied guide wedge 13, or respectively between two individual guide wedges 37 to 40, or to the left or right of these, in the direction toward the conveying track 52. By means of this, the path of the signatures 6 along the lower guide surface 16 of the "teeth" or individual guide wedges 37 to 40 is temporarily blocked. Both conveyor belts 3, 4 then run above the deflection edge 12 of the "teeth" of the guide wedge 13, or respectively the individual guide wedges 37 to 40 as seen in FIG. 1. Expressed in other words, in the course of this, the lower conveyor belt 4 moves with its entire or partial thickness through the free spaces enclosed on both sides by the virtual extension—viewed in the axial direction of the cam rows 1, or respectively 2—of the upper guide surface 14 and the lower guide surface 16. Namely from the direction above the upper guide surface 14 and extending past the lower guide surface 16.

When the cam rows 1, 2 continue to rotate, the trailing end of the signature 6 on the upper track finally passes by the thin end 10 of the teeth, or respectively of the individual guide wedges 37 to 40. Now the high control surfaces 23 of the high cams 20 to 22 of the first or upper cam row 1 work against the low control surfaces 33 of the low cams 30 to 32 of the second or lower cam row 2 in order to guide the respective signature 7, which follows the signature 6, along the lower guide surface 16 to the lower conveying track 52.

In this way, a signature 6, or respectively 7, or the inner face of a conveyor belt 3, or respectively 4, are alternatingly moved, slidingly or at a short distance of, for example, 0.1 mm, past the guide surfaces 14, or respectively 16, of the individual guide wedges 37 to 40 or of the guide wedge 13.

A further advantage of the device of the invention also resides in that, because of the alternating passage of the conveying belts 3, 4 through the thin end 10 of the guide wedge 13, or respectively of the space enclosed by the virtual guide surface 19, 24, a front of a signature 6, 7 cannot bump against a deflection edge 12 of the guide wedge 13.

While a preferred embodiment of a device for dividing the flow of signatures in accordance with the present invention has been set forth fully and completely hereinabove, it will be apparent to one of skill in the art that a number of changes in, for example, the type of printing press used to print the signatures, the motive power source for the conveyor belts and the like could be made without departing from the true spirit and scope of the present invention which is accordingly to be limited only by the following claims.

What is claimed is:

1. A device for rerouting signatures comprising:

a first conveyor belt system having first conveyor belts, and a second conveyor belt system having second conveyor belts, said first and second conveyor belts cooperating to clamp signatures and to move the clamped signatures in a signature conveying direction along a signature infeed track;

a first signature conveying track and a second signature conveying track;

a stationary guide wedge system extending transversely to said conveying direction of travel of said first and second conveyor belts, said stationary guide wedge system having an upper guide surface, a lower guide surface, a thin, leading edge and a thick trailing edge, said first conveyor belts and said second conveyor belts diverging at said thin leading edge, said first conveyor belts extending along said first signature conveying track and said second conveyor belts extending along said second signature conveying track;

upper grooves on said upper guide surface adjacent said leading edge, and lower grooves on said lower guides surface adjacent said leading edge;

an upper plane defined by said upper guide surface, and a lower plane defined by said lower guide surface, said upper and lower planes defining a wedge-shaped space surrounding said stationary guide web;

a first cam row and a second cam row, said first cam row engaging said first conveyor belts and said second cam row engaging said second conveyor belts, each of said cam rows having spaced cams, each said spaced cam having a high cam surface and a low cam surface; and means for rotating said first cam row and said second cam row to alternatingly introduce said first conveyor belts and said second conveyor belts into said wedge-shaped space and into said upper grooves and said lower grooves.

2. The device in accordance with claim 1 wherein said guide wedge system is a single guide wedge having said upper and lower grooves.

3. The device in accordance with claim 1 wherein said guide wedge system includes a plurality of guide wedges, said guide wedges being arranged transversely to said conveying direction and being axially spaced apart.

4. The device of claim 3 further including a cross beam extending transverse to said conveying direction, said plurality of guide wedges being secured to said cross beam.

5. The device of claim 1 wherein said cams of said first and said second cam rows mesh with each other.

6. The device of claim 1 wherein said first and second cam rows each have two rows of cam disks whose cams mesh with each other.

7. The device of claim 5 wherein each of said cams has a first control surface with a first radius and a second control surface with a second radius, said first radius being greater than said second radius.

8. The device of claim 6 wherein each of said cams has a first control surface with a first radius and a second central surface with a second radius, said first radius being greater than said second radius.

9. The device of claim 7 wherein each of said first radius control surfaces on said first cam row can be brought into engagement with said first conveyor belts, and further wherein each of said second radius control surfaces on said second cam row can be brought into engagement with said second conveyor belts.

10. The device of claim 8 wherein each of said first radius control surfaces on said first cam row can be brought into engagement with said first conveyor belts, and further wherein each of said second radius control surfaces on said second cam row can be brought into engagement with said second conveyor belts.

11. The device of claim 5 wherein a number of said cams of said first cam row is a whole number multiple of a number of said cams of said second cam row.

12. The device of claim 6 wherein a number of said cams of said first cam row is a whole number multiple of a number of said cams of said second cam row.

13. The device of claim 5 further including free spaces located axially between adjacent ones of said cams of each of said first and second cam rows, said spaces on said first and second cam rows being located opposite from each other.

14. The device of claim 6 further including free spaces located axially between adjacent ones of said cams of each of said first and second cam rows, said spaces on said first and second cam rows being located opposite from each other.

15. The device of claim 5 wherein said cams are driven, eccentrically seated circular disks.

16. The device of claim 6 wherein said cams are driven, eccentrically seated circular disks.

17. The device of claim 1 wherein said guide wedge system is comb-shaped and has individual guide wedge sections arranged tooth-like adjacent each other in an axial direction of said guide wedge system.

18. The device of claim 1 wherein at least one of said guide surfaces is concave.

* * * * *